US006625291B1

(12) United States Patent
Mohler

(10) Patent No.: US 6,625,291 B1
(45) Date of Patent: Sep. 23, 2003

(54) DIFFUSED RESONANCE LOUDSPEAKER ENCLOSURE METHOD

(75) Inventor: David S. Mohler, Westminster, CO (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/286,751

(22) Filed: Apr. 6, 1999

(51) Int. Cl.[7] ..... H04R 25/00

(52) U.S. Cl. ..... 381/337; 381/345; 381/352; 381/182

(58) Field of Search ..... 381/338, 345, 381/349, 351, 352, 182, 186, FOR 151, FOR 146, 160; 181/155, 156, 144, 145, 147, 199

(56) References Cited

U.S. PATENT DOCUMENTS 3,912,866 A * 10/1975 Fox ..... 181/155
4,063,387 A * 12/1977 Mitchell ..... 381/160
4,200,170 A * 4/1980 Williams, Jr. ..... 181/155
5,266,752 A * 11/1993 Cussans ..... 181/155
6,152,257 A * 11/2000 Denham ..... 181/155

* cited by examiner

*Primary Examiner*—Huyen Le
(74) *Attorney, Agent, or Firm*—David Volejnicek

(57) ABSTRACT

The present invention includes a loudspeaker system having at least one loudspeaker drive unit; at least one loudspeaker enclosure for housing the loudspeaker drive unit(s), the loudspeaker enclosure(s) having resonating chamber(s), wherein the loudspeaker drive unit(s) produces at least one standing wave in the resonating chamber(s); and at least one internal resonance control structure, the internal resonance control structure being positioned within the loudspeaker enclosure to form a tapering cross-sectional area within the resonating chamber(s) in relation to the loudspeaker drive unit(s) to substantially diffuse the standing wave.

14 Claims, 4 Drawing Sheets

DIFFUSED RESONANCE LOUDSPEAKER ENCLOSURE METHOD

BACKGROUND OF THE INVENTION

1. Field of the Invention

The present invention relates to a loudspeaker system, particularly to low cost, high performance loudspeaker enclosures, and more particularly to a diffused resonance loudspeaker system.

2. Description of the Prior Art

Rectangular loudspeaker enclosures constructed from wood, particle board, and plywood are commonly used by both consumers and professionals in the audio industry. A conventional rectangular enclosure having a height X, a width Y, and a depth Z exhibits three internal standing waves at a frequency calculated as $f=1100\times l$, where f is the frequency of the standing wave and l is the dimension of the enclosure (X, Y, or Z) in feet. Thus, the frequency of the three standing waves is determined by the dimension of the enclosure.

In these prior art systems, materials such as fiberglass, foam plastics, long-fiber wool, and synthetic fibers have been used to line the interior of the enclosure in an effort to dampen the standing waves. These prior art systems also typically include internal structures for bracing and supporting the enclosure, but these structures do not provide any significant or effective resonance control.

For example, perimeter braces, which are commonly used, do not adequately deal with these standing waves. Conventional internal matrix structures, which are used in some cases, shift the standing waves to higher frequencies, but still have the significant disadvantage that they alter internal resonance, as defined by the above equation.

Unusually shaped enclosures, such as cylinders, egg-shapes, hedrons, and transmission lines have also been employed in the prior art. However, with the exception of certain egg-shape and straight/tapered transmission lines, these enclosures provide inadequate resonance control. Moreover, the unusually shaped systems which have exhibited adequate resonance control, such as the B & W Nautilus concept and the Waveform egg, have the significant disadvantage that they are extremely costly, and are impractical for low-cost, high performance enclosures.

SUMMARY OF THE INVENTION

Thus a loudspeaker system is needed which is capable of exhibiting excellent resonance control, while being inexpensive to produce and use. Accordingly, the present invention is directed to a loudspeaker system employing an inexpensive enclosure having an internal divider situated to produce diffused resonance control.

The present invention includes a loudspeaker system having at least one loudspeaker drive unit; a loudspeaker enclosure for housing the loudspeaker, the loudspeaker enclosure having a resonating chamber, wherein the loudspeaker drive unit produces at least one standing wave in the resonating chamber; and at least one internal resonance control structure, the internal resonance control structure being positioned within the loudspeaker enclosure to form a tapering cross-sectional area within the resonating chamber in relation to the loudspeaker drive unit to substantially diffuse the standing wave.

The internal resonance control structure of the present invention may include a tapered pyramidal shape having a bottom portion, a tapering midsection, and an apex portion, wherein said apex portion is located proximally to the loudspeaker drive unit. It may also include four tapering pyramidal shapes each having a bottom portion, a tapering, perforated midsection, and an apex, wherein the apex of each of the pyramidal shapes is located proximally to the apex of each of the other pyramidal shapes, or two slotted, perforated dividers, said dividers being configured within the loudspeaker enclosure to produce four tapering pyramidal shapes.

The present invention may also include a second loudspeaker drive unit and a high frequency loudspeaker drive unit, wherein the internal resonance control structure has two perforated dividers and one solid divider, and wherein the two perforated dividers and the solid divider are configured within the resonating chamber such that each of the perforated dividers is parallel to each other and is equidistant across the center of each of the loudspeakers and does not cross the high frequency loudspeaker, and the solid divider is perpendicular to the two perforated dividers across the high frequency loudspeaker and not across the loudspeakers. Similarly, a plurality of loudspeaker drive units serving a plurality of frequency bands can benefit from this method as will be obvious to those skilled in this art.

DETAILED DESCRIPTION

The present invention will be understood more fully from the detailed description given below and from accompanying drawings of preferred embodiments of the invention, which, however, should not be taken to limit the invention to a specific embodiment, but are for explanation and understanding only.

Figure 1:
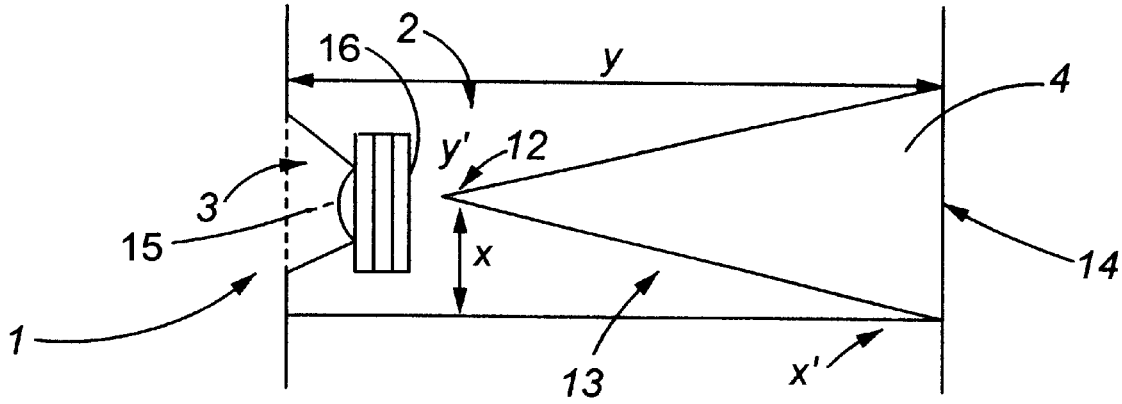
FIG. 1 is a diagram illustrating the components and configuration of a preferred embodiment of the present invention.

A first preferred embodiment of the present invention is shown in FIG. 1. As shown in FIG. 1, Loudspeaker Enclosure 1 contains a Resonating Chamber 2 located proximally to Loudspeaker drive unit 3. Loudspeaker Enclosure 1 may be constructed from a number of conventional materials well known to those skilled in the art, such as plywood, particle board, and the like.

Loudspeaker Enclosure 1 may be formed in a number of conventional speaker enclosure shapes, such as rectangular, cylindrical, and the like. However, in the preferred embodiment shown in FIG. 1, Loudspeaker Enclosure 1 and Resonating Chamber 2 are preferably cylindrical.

Resonating Chamber 2 further includes Internal Resonance Control Structure 4, which in this preferred embodiment is formed in a conical shape. A non-rectangular shape is preferred. In the embodiment shown in FIG. 1, the tapering shape has a circular base and cross-section, since Resonating Chamber 2 is preferably cylindrical in shape. However, Internal Resonance Control Structure 4 may also comprise a rectangular (four sided) pyramidal shape (not shown) or a triangular pyramidal shape (not shown), or other like polygons. Loudspeaker drive unit 3 has a front 15 and a back 16. Apex 12 of the tapering shape is located proximally to back 16 of Loudspeaker drive unit 3, as shown in FIG. 1. Tapering midsection 13 and Bottom Portion 14 of the tapering shape are thus located away from Loudspeaker drive unit 3.

Configuring Internal Resonance Control Structure 4 in this manner creates a tapering cross-sectional area in Resonating Chamber 2 in all three dimensions (X, Y, and Z), which diffuses the standing waves formed by Loudspeaker drive unit 3. As shown in FIG. 1, height x at the apex of Internal Resonance Control Structure 4 tapers down to height x'. This reduction in height also occurs at heights y and y', and z and z' (not shown). Thus, the cross-sectional area tapers in all three dimensions. Tapering the cross-sectional area of Resonating Chamber 2 produces resonating frequencies with wavelengths that vary in each dimension (X, Y, and Z).

Figure 2A:
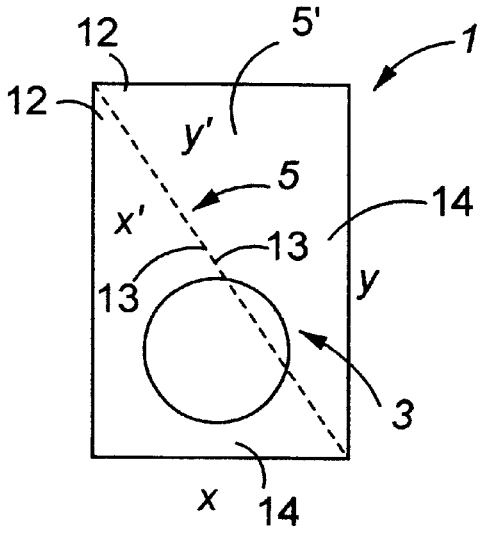
FIGS. 2(*a*)–(*b*) are diagrams illustrating the components and configuration of a second preferred embodiment of the present invention.
Figure 2B:
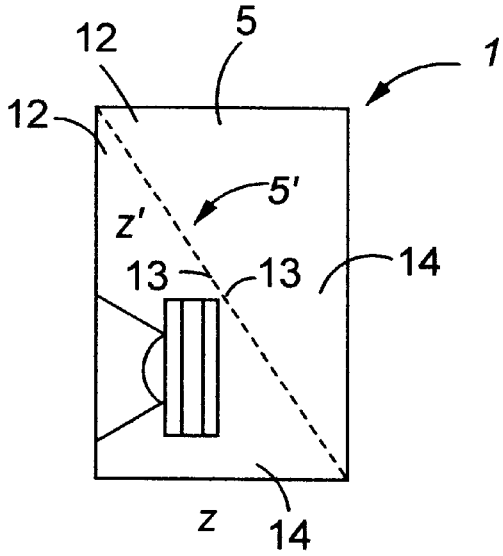

A second preferred embodiment is shown in FIG. 2(*a*) and 2(*b*). FIG. 2(*a*) is a front view of the encloseure, showing dimensions X and Y, while FIG. 2(*b*) is a side view, additionally showing Dimension Z. In this embodiment, Loudspeaker Enclosure 1 is a rectangular box. Loudspeaker Enclosure 1 contains Perforated Dividers 5 and 5' as the internal resonance control structure.

Figure 3A:
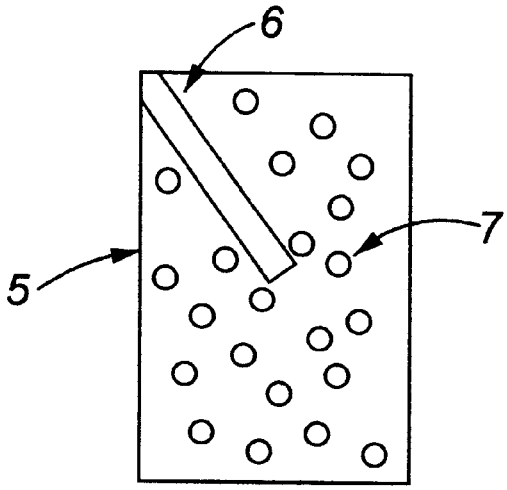
FIGS. 3(*a*)–(*b*) are diagrams illustrating a perforated divider of the present invention.
Figure 3B:
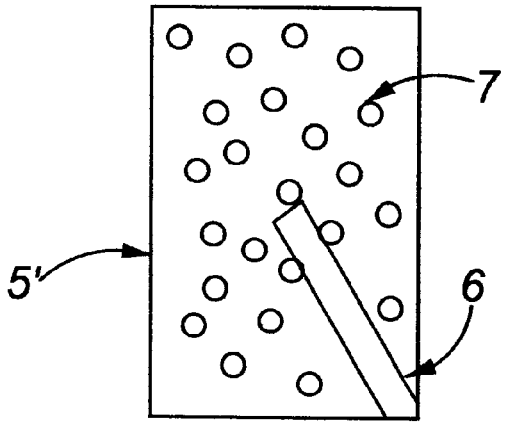

FIGS. 3(*a*) and 3(*b*) illustrate the components of Perforated Dividers 5 and 5'. Each of the dividers 5 and 5' includes Slot 6, which allows the dividers 5 and 5' to be placed crosswise to each other in Loudspeaker 1, as shown in FIGS. 2(*a*) and 2(*b*) by the dashed lines.

Configuring the dividers in this manner creates four tapering pyramidal shapes, each having a bottom 14, a tapering midsection 13, and an apex 12, wherein the apex of each of the pyramidal shapes is located proximally to the apex of each other of the pyramidal shapes. Thus, the cross-sectional area tapers in all three dimensions inside Resonating Chamber 2. This produces resonating frequencies with wavelengths that vary in each dimension (X, Y, and Z).

The midsections 13 of dividers 5 and 5' also may include Perforations 7, which allow for air flow among the sections formed inside Loudspeaker Enclosure 1 and Resonating Chamber 2. This ensures that the entire enclosure may be used, preventing one of the sections from being closed off, which would necessitate an increase in the size of the chamber by 25%. Perforations 7 may be sized having varying dimensions. They may also preferably have dimensions outside of the pass-band of Loudspeaker drive unit 3, providing the significant benefit that they would not resonate within the pass-band.

This configuration also provides the additional significant benefit that Loudspeaker Enclosure 1 is structurally reinforced diagonally, which is the weakest plane.

Figure 4A:
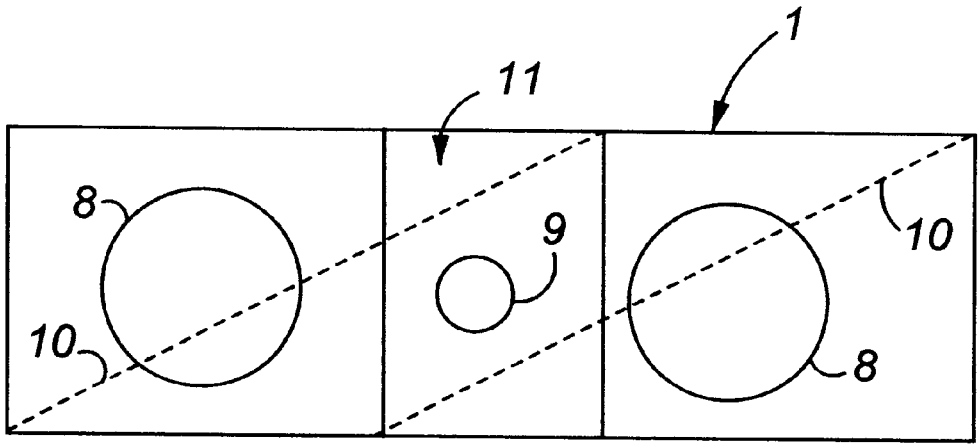
FIG. 4(*a*)–(*b*) is a diagram of another preferred embodiment of the present invention.
Figure 4B:
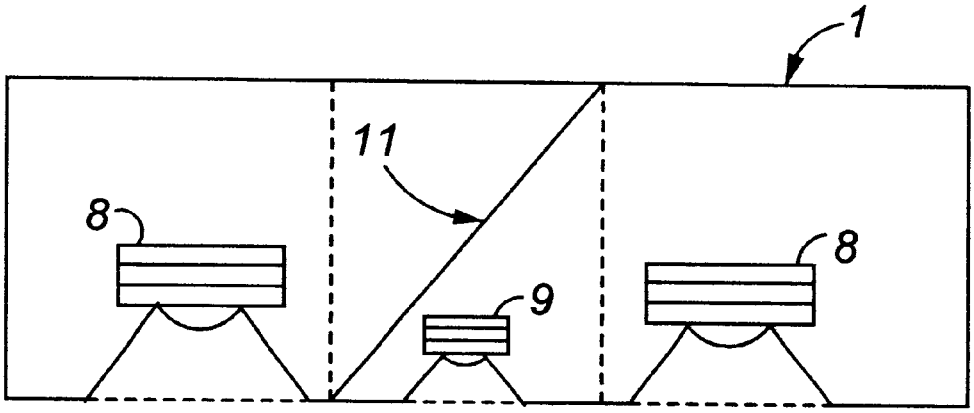

Another preferred embodiment of the present invention is shown in FIGS. 4(*a*)–4(*b*). This variation is based upon the MTM or D'Appolito configuration, which has the loudspeaker drive units mounted symmetrically, on either side of tweeter. As shown in FIGS. 4(*a*)–4(*b*), two Loudspeakers Drive Units 8 are located on either side of High Frequency Loudspeaker Drive Unit 9.

Two Perforated Dividers 10 and Solid Divider 11 are configured such that each of Perforated Dividers 10 are parallel to each other and are equidistant across the center of each of Loudspeaker Drive Units 8. Perforated Dividers 10 do not cross High Frequency Loudspeaker Drive Unit 9, and Solid Divider 11 is configured perpendicular to Perforated Dividers 10 across High Frequency Loudspeaker Drive Unit 9 and not across Loudspeaker Drive Units 8. Again, the cross-sectional area tapers inside the resonating chamber, producing resonating frequenies with wavelengths that vary in each dimension.

Although the present invention has been described in its preferred embodiments with reference to the accompanying drawings, it can be readily understood that the present invention is not restricted to the preferred embodiments and that various changes and modifications can be made by those skilled in the art without departing from the spirit and scope of the present invention.

What is claimed is:

1. A loudspeaker system comprising:

at least one loudspeaker drive unit;

at least one loudspeaker enclosure for housing said loudspeaker drive unit(s), said loudspeaker enclosure(s) having at least one resonating chamber(s) therein, wherein said loudspeaker drive unit(s) produces at least one standing wave in said resonating chamber(s);

at least one internal resonance control structure, said internal resonance control structure being positioned within said loudspeaker enclosure to form a tapering cross-sectional area within said at least one resonating chamber(s) tapering outwardly from an apex proximal to said loudspeaker drive unit(s) to substantially diffuse said standing wave;

wherein said at least one loudspeaker drive unit comprises two low- or mid-frequency loudspeaker drive units and a high frequency loudspeaker drive unit, wherein said internal resonance control structure comprises two perforated dividers and one solid divider, and wherein said two perforated dividers and said solid divider are configured within said resonating chamber such that each of said perforated dividers is substantially parallel to each other and is substantially equidistant across the center of each of said low- or mid-frequency loudspeaker drive units and does not cross said high frequency loudspeaker drive unit, and said solid divider is substantially perpendicular to said two perforated dividers across said high frequency loudspeaker and not across said low- or mid-frequency loudspeaker drive units.

2. A loudspeaker system comprising:

at least one loudspeaker drive unit having a front facing a direction in which the drive unit outputs front waves and a back oriented toward a direction in which the drive unit outputs rear waves;

at least one loudspeaker enclosure for housing said loudspeaker drive unit(s), said loudspeaker enclosure(s) having a resonating chamber for each of said loudspeaker drive unit(s), wherein said loudspeaker drive unit(s) produces at least one standing wave in said resonating chamber(s); and at least one substantially tapering internal structure having a bottom portion, a tapering midsection, and an apex portion, wherein said apex portion is located proximally to said back of said loudspeaker drive unit(s) and said midsection extends from said apex portion to said bottom portion away from said loudspeaker drive unit (s), said internal structure being positioned within said loudspeaker enclosure(s) to form a tapering cross-sectional area within said resonating chamber(s) of said loudspeaker drive unit(s) tapering outwardly from said apex in relation to said loudspeaker drive unit(s) to substantially diffuse said standing wave.

3. The loudspeaker system of claim 2, wherein said internal structure has a tapered substantially conical shape.

4. The loudspeaker system of claim 2, wherein said internal structure is a substantially polygon-based pyramid.

5. The loudspeaker system of claim 2, wherein said internal structure comprises two slotted, perforated dividers, said dividers being configured within said loudspeaker enclosure to produce four tapering substantially pyramidal shapes within said resonating chamber.

6. A loudspeaker system comprising:

one or more loudspeaker drive unit(s);

one or more loudspeaker enclosure(s) for housing said loudspeaker drive unit(s), said loudspeaker enclosure (s) having resonating chamber(s), wherein said loudspeaker drive unit(s) produces at least one standing wave in said resonating chamber(s); and two slotted, perforated dividers, said dividers being configured within each of said loudspeaker enclosure(s) to produce four tapering pyramidal shapes within said resonating chamber(s), said tapering pyramidal shapes being positioned within said loudspeaker enclosure to form a tapering cross-sectional area within said resonating chamber(s) in relation to said loudspeaker drive unit(s) to substantially diffuse said standing wave.

7. The loudspeaker system of claim 6, wherein said loudspeaker enclosure is substantially rectangular in shape.

8. The loudspeaker system of claim 7, wherein said internal resonance control structure comprises four tapering substantially pyramidal shapes each having a bottom portion, a tapering midsection, and an apex portion, wherein said apex portion of each of said pyramidal shapes is located proximally to said apex portion of each other of said pyramidal shapes.

9. The loudspeaker system of claim 8, wherein said tapering midsection of each of said pyramidal shapes comprises perforations sized to not resonate in pass-band of said loudspeaker drive unit.

10. The loudspeaker system of claim 6, wherein said tapering, pyramidal shapes comprise perforations sized to not resonate in pass-band of said loudspeaker drive unit(s).

11. A loudspeaker system comprising:

at least two low or mid frequency loudspeaker drive units;

one high frequency loudspeaker drive unit;

a loudspeaker enclosure for housing said two low or mid frequency loudspeaker drive units and said high frequency loudspeaker drive unit;

two perforated dividers; and one solid divider, wherein said two perforated dividers and said solid divider are configured within said resonating chamber such that each of said perforated dividers is substantially parallel to each other and is substantially equidistant across the center of each of said low or mid frequency loudspeaker drive units and does not cross said high frequency loudspeaker drive unit, and said solid divider is substantially perpendicular to said two perforated dividers across said high frequency loudspeaker drive unit and not across said low or mid frequency loudspeaker drive units.

12. A loudspeaker system comprising:

one or more loudspeaker drive unit(s);

one or more loudspeaker enclosure(s) for housing said loudspeaker drive unit(s), said loudspeaker enclosure (s) having at least one resonating chamber(s), wherein said loudspeaker drive unit(s) produces at least one standing wave in said resonating chamber(s); and at least one internal resonance control structure, said internal resonance control structure being positioned within said loudspeaker enclosure and comprising four tapering substantially pyramidal shapes each having a bottom portion, a tapering midsection, and an apex portion, wherein said apex portion of each of said pyramidal shapes is located proximally to said apex portion of each other of said pyramidal shapes, wherein said tapering midsection of each of said pyramidal shapes contains perforations sized to not resonate in pass-band of said loudspeaker drive unit.

13. A loudspeaker system comprising:

one or more loudspeaker drive unit(s);

one or more loudspeaker enclosure(s) for housing said loudspeaker drive unit(s), said loudspeaker enclosure (s) having at least one resonating chamber(s), wherein said loudspeaker drive unit(s) produces at least one standing wave in said resonating chamber(s); and at least one internal resonance control structure comprising two slotted, perforated dividers, said dividers being configurd to produce four tapering substantially pyramidal shapes within said resonating chamber.

14. A loudspeaker system comprising:

at least two low- or mid-frequency loudspeaker drive units and a high frequency loudspeaker drive unit;

at least one loudspeaker enclosure for housing said loudspeaker drive units, said loudspeaker enclosure(s) having at least one resonating chamber(s), wherein said loudspeaker drive units produce at least one standing wave in said resonating chambers; and at least one internal resonance control structure comprising two perforated dividers and one solid divider, wherein said two perforated dividers and said solid divider are configured within said resonating chamber such that each of said perforated dividers is substantially parallel to each other and is substantially equidistant across the center of each of said low- or mid-frequency loudspeaker drive units and does not cross said high frequency loudspeaker drive unit, and said solid divider is substantially perpendicular to said two perforated dividers across said high frequency loudspeaker and not across said low- or mid-frequency loudspeaker drive units.

* * * * *